United States Patent [19]

le Duc

[11] Patent Number: 4,864,901

[45] Date of Patent: Sep. 12, 1989

[54] ADJUSTABLE WRENCH SOCKET

[76] Inventor: Don le Duc, 2405 Alvarado Dr., Santa Clara, Calif. 95051

[21] Appl. No.: 228,485

[22] Filed: Aug. 5, 1988

[51] Int. Cl.[4] ..... B25B 13/16

[52] U.S. Cl. ..... 81/163; 81/170

[58] Field of Search ..... 81/163, 165, 170, 177.7, 81/177.75

[56] References Cited

U.S. PATENT DOCUMENTS 1,046,216 12/1912 Olson ..... 81/165

1,077,575 11/1913 Wutke ..... 81/165 X 1,456,290 5/1923 Tell ..... 81/165

1,612,713 12/1926 Fienberg ..... 81/163 X

*Primary Examiner*—James G. Smith

[57] ABSTRACT

An adjustable wrench socket of the screw adjustment type in which two identical jaws facing each other have a multiple non-slip grip on nut and screw heads and in which the jaw movements are synchronized in respect to the axis of their mutual housing that slidably engages them but controls them in all other unwanted directions and further provides for adaptability to commercial drives and their extensions.

2 Claims, 1 Drawing Sheet

ADJUSTABLE WRENCH SOCKET

BACKGROUND OF THE INVENTION

This invention relates to sockets and the tools used therewith.

The first consideration given to the construction of an adjustable socket is the understanding of the forces that are imposed on the tool. Because the socket is split from a single round part to two or more pieces, the tool is inheritably weaker.

In applying torque to the adjustable socket when it is engaged with a bolt, the jaws are cammed outward in trying to override the high points of the hexagonal bolt head. In being held by the adjust screw, which allows rotation, the outward motion translates to a twist. The twisting motion is either clockwise or counter-clockwise. After all the play between the mating threads of jaws and adjust screw has been taken up, additional torque will damage the threads and bend the screw, the weaker to be first.

Such practice is found in U.S. Pat. No. 1,612,713. To overcome this problem, the jaws or extensions of the jaws should be guided over an adequate distance, for if not, the guiding body will be wedged apart by the leverage of the jaws themselves as is forseen to happen in U.S. Pat. No, 1,046,216.

If only one jaw is provided with a supporting and guiding extension, and the other jaw is constructed to receive the extension, then the required length of the extension will project outside the body of the other jaw by an objectionable distance, which is the longest when the jaws are turning the smallest bolt. This forms the second consideration, which is that the turning clearance of the socket should be kept to a minimum.

In machinery and automotive design, only small clearances are given around nuts, bolts, screws and other hardware. From this it is learned that expansion features should ideally be shared by both jaw members. The prior art such as disclosed in U.S. Pat. No. 1,456,290 and 1,621,264 involve this drawback.

SUMMARY OF THE INVENTION

It is therefore a general object of this invention to provide a socket which overall bulk and contour is comparable to that of conventional sockets so that the advantages gained through adjustability are not lost through inability to use the socket in restricted spaces where the conventional sockets can be used.

This and other objects and advantages of the invention will more fully appear from the following description, made in connection with the accompanying drawings, wherein like reference characters refer to the same or similar parts throughout the several views and in which:

DESCRIPTION OF THE PREFERRED EMBODIMENT

Figure 3:
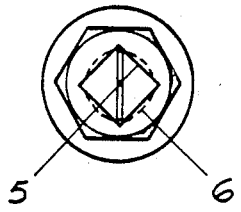
FIG. 3 is a top elevation of FIG. 2.
Figure 1:
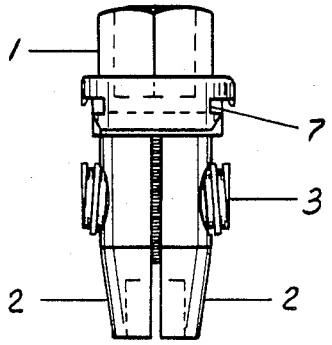
FIG. 1 is a front elevation of the tool with the jaws closed.
Figure 2:
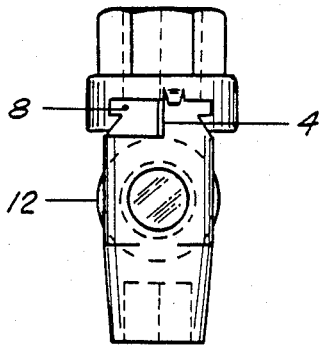
FIG. 2 is a side elevation of FIG. 1.
Figure 4:
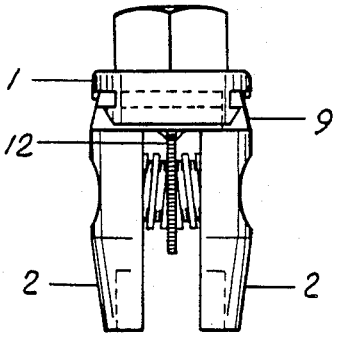
FIG. 4 is a front elevation of the tool with the jaws fully opened.
Figure 6:
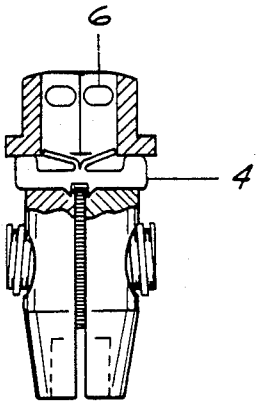
FIG. 6 is a front elevation with the top portion in cross section.
Figure 5:
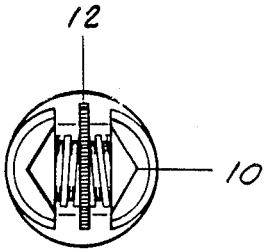
FIG. 5 is a bottom elevation of FIG. 4.
Figure 7:
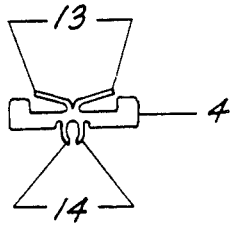
FIG. 7 is a detail of the locking washer with the feature of brakes included.

In the form of my design herein illustrated, the socket consists of: a head 1, within which are slidably mounted two movable jaws 2, an adjust screw 3 connected to the movable jaws and a thin and flat locking washer 4.

Circular head 1 has a square hole 5 formed through the center and the walls are provided with friction ball detents 6 as in the conventional method for receiving external drives. The bottom portion of the head is broached to a T-shaped guideway 7 for slidable engagement with inverted L-shaped guides 8 on tangs 9 of jaws 2. Tangs 9 are projected at a 90° angle to the jaw body and in particular to a V-shaped recess 10 located at the lower end of the jaw body. The V-shaped recess of a 120° angle adapts to the hexagonal nuts and bolts and the two jaws facing each other in the assembly will provide a four-sided non-slip grip on the fasteners. Between the tangs and the V-shaped recess a threaded through hole is provided in the jaw bodies, one has a left and the other a right-hand thread for receiving the right and left-hand threaded adjust screw 3. The adjust screw has a centered adjust ring 12 which is knurled on its circumference for ease of rotation. In the assembly tangs 9 are spaced apart by locking washer 4 which keeps the head 1 centered to the jaws at all times throughout jaw adjustments. This locking washer is symmetrically shaped and features an upper and lower pair of resilient arms 13 and 14 respectively. Upper arms 13 must be depressed when the jaws 2 are slid into the head 1 at assembly, and will have sprung up again inside the hole of the head. Lower arms 14 cradle the adjust ring 12 and exert a moderate and equal pressure on the sides of the ring, thus acting as caliper brakes. This feature maintains jaw adjustment during frequent removal from the same size of hardware and during which it is possibly tossed around.

Having fully described the invention, what I claim as new, and desire to secure by Letters Patent of the United States, is:

1. An adjustable socket comprising two jaw members facing one another; one jaw member having a left hand threaded through hole and the other having a right hand threaded through hole; angular faces on one end of the jaw members and inverted L-shaped guides on angular tangs on the other end cooperating with a T-shaped guideway at a lower end of a circular head which is staked at both ends to capture the jaws in the socket; a square hole broached through the center of said circular head with friction ball detents formed into (a wall) at least one of the walls of the square hole; an adjust screw with opposite threads on each side of a centered adjust ring connecting said jaw members; a locking washer placed between said angular tangs having a pair of resilient arms extending from one side of said locking washer reaching into and spanning the diagnonal length of the square hole and having a centered U-shaped notch at the other side of the locking washer to cradle the width of the adjust ring.

2. An adjustable socket comprising two jaw members facing one another; one jaw member having a left hand threaded through hole and the other having a right hand threaded through hole; angular faces on one end of the jaw members and inverted L-shaped guides on angular tangs on the other end cooperating with a T-shaped guideway at a lower end of a circular head which is staked at both ends to capture the jaws in the socket; a square hole broached through the center of said circular head with friction ball detents formed into (a wall) at least one of the walls of the square hole; an adjust screw with opposite threads on each side of a centered adjust ring connecting said jaw members; a locking washer placed between said angular tangs having a pair of resilient arms extending from one side of said locking washer reaching into and spanning the diagnonal length of the square hole and having a centered U-shaped notch at the other side of the locking washer to cradle the width of the adjust ring; the U-shaped notch defined by a second pair of resilient arms which will exert moderate pressure to each side of said adjust ring.

* * * * *